US007999652B2

(12) United States Patent
Harada et al.

(10) Patent No.: US 7,999,652 B2
(45) Date of Patent: Aug. 16, 2011

(54) THICK FILM RESISTOR

(75) Inventors: Ken Harada, Fuchu (JP); Minoru Sakamaki, Hitachinaka (JP); Isao Matsui, Wako (JP)

(73) Assignees: Hitachi, Ltd., Tokyo (JP); Hitachi High-Technologies Corporation, Tokyo (JP)

( * ) Notice: Subject to any disclaimer, the term of this patent is extended or adjusted under 35 U.S.C. 154(b) by 366 days.

(21) Appl. No.: 12/339,036

(22) Filed: Dec. 18, 2008

(65) Prior Publication Data

US 2009/0174523 A1 Jul. 9, 2009

(30) Foreign Application Priority Data

Dec. 21, 2007 (JP) ..... 2007-330388

(51) Int. Cl.
*H01C 10/00* (2006.01)

(52) U.S. Cl. ..... 338/195; 338/283; 338/287

(58) Field of Classification Search ..... 338/195, 338/280, 283, 287, 333, 334
See application file for complete search history.

(56) References Cited

U.S. PATENT DOCUMENTS 4,306,217 A * 12/1981 Solow ..... 338/275
4,342,217 A * 8/1982 Paetow ..... 73/1.15
4,908,599 A * 3/1990 Breen et al. ..... 338/22 R
6,292,091 B1 * 9/2001 Kambara et al. ..... 338/195
6,836,207 B2 * 12/2004 Nothhelfer et al. ..... 338/138
7,057,491 B2 * 6/2006 Dempsey ..... 338/320

FOREIGN PATENT DOCUMENTS

| | | | |
|---|---|---|---|
| JP | 06-037252 | A | 2/1994 |
| JP | 09-097707 | A | 4/1997 |
| JP | 11-150011 | A | 6/1999 |
| JP | 2002-008902 | A | 1/2002 |
| JP | 2007-142240 | A | 6/2007 |

* cited by examiner

*Primary Examiner* — Kyung Lee
(74) *Attorney, Agent, or Firm* — Miles & Stockbridge P.C.

(57) ABSTRACT

In a flat plate type thick film resistor, an insulation performance is improved by excluding the nonuniformity of potential distribution on a wiring plane, which is generated when electric current flows in a resistance wire. Simultaneously, generation of noise depending on potential distribution and variation of stray capacitance around a resistor is suppressed. When the resistance wire having a constant thickness and uniform resistivity, which is formed on an insulating substrate, is connected to a pair electrode conductors that face to each other, in the way that the resistance wire is repetitively bent to the alternate side in zigzags, a potential gradient on the wiring plane, which is generated when electric current flows in the resistance wire, is constant by properly selecting the line width, the bending angle, and the spacing between bending vertexes of a resistance wire.

12 Claims, 6 Drawing Sheets

THICK FILM RESISTOR

CLAIM OF PRIORITY

The present application claims priority from Japanese patent application JP2007-330388 filed on Dec. 21, 2007, the content of which is hereby incorporated by reference into this application.

BACKGROUND OF THE INVENTION

1. Field of the Invention

The present invention relates to a thick film resistor constituting an electronic component and a wiring pattern thereof.

2. Description of the Related Art

A thick film resistor is widely used for electronic components such as a chip resistor, a resistor network, a hybrid IC, etc. and is generally used as a high-voltage segmented resistor even in a high-voltage power supply and a constant-current power supply of a charged particle beam device such as an electron microscope, etc. The thick film resistor is generally classified into two types, that is, such as a round bar type and a flat plate type, which are classified by their external shape. In the round bar type, a wiring pattern with a resistive paste material is formed on the surface of a column of an insulating bar and in the flat plate type, the wiring pattern is formed on one surface of an insulating substrate. Both resistors are similar in that the resistivity of a used paste material and dimensional sizes such as the thickness, width, and length of a patterned wire after sintering the paste material are designed, and a final resistance value is controlled by a trimming process after the sintering. The thick film resistor used for a high-voltage device is generally used under a high voltage application, an insulation performance is determined by the spacing between the adjacent resistance wires. Therefore, it is preferable that the spacing is wide, but since there is a limit in the size of the resistor and an area in which the paste material can be applied, the thick film resistor is designed by comprehensively determining a geometrical size of the resistance wire while selecting the resistivity of the paste material. Further, a measure for securing a resistance to high pulse-voltage suddenly generated at the time of applying the high voltage is discussed while taking into consideration of a pattern of the resistance wire (see JP-A-2007-142240).

SUMMARY OF THE INVENTION

A manufactured resistor is generally classified into two types, that is, a round bar type and a flat plate type. In the past, a wiring pattern of a resistance wire was not considered, until recently, except that a resistance value is controlled by geometrical sizes of all patterned wires and an insulation performance is secured by the spacing between adjacent resistance wires.

However, various studies have been conducted relating to securing the accuracy of a final resistance value, improving current noise, and a trimming method performed after sintering a resistance pattern. For example, the trimming method includes L-shaped and U-shaped trimming processes (see JP-A-H06 (1994)-37252 and JP-A-H09 (1997)-97707), a method of performing a trimming termination process outside of the resistance pattern (see JP-A-2002-8902), and a method of performing an annealing process and an auxiliary retrimming process after a trimming process (see JP-A-H11 (1999)-150011).

FIG. 1 is a schematic diagram illustrating a wiring pattern of a flat plate type thick film resistor in the related art. A pair of electrode conductors 012 that are configured to face an insulating substrate 011 are connected to each other by means of resistance wires 021 that are zigzagged. Reference numeral 013 in FIG. 1 represents a resistor lead wire. Since the resistance wire having uniform resistivity, uniform thickness, and uniform line width is formed, a potential difference generated by a voltage drop caused due to electric current flow in the resistance wire is small between the resistance wires that face each other inside of a bend section and is large outside of the bend section in proportion to a length of the resistance wire between two points to be measured. Therefore, a potential gradient generated on a plane where the resistance wire is alternately disposed is fast or slow depending on a bending direction of the resistance wire. In FIG. 1, the wiring is drawn by bending a straight line for the convenience of preparing the drawing, although, because the wiring is drawn for an electronic component, the wiring must be smoothly prepared so as not to make the vertex fruitlessly. The same components as components shown in FIG. 1 may be omitted even in the drawings.

FIG. 2 is a schematic diagram of an equipotential line on the plane where the resistance wire is disposed. The spacing between equipotential lines 041 is narrowed outside of the bend section of the resistance wire in which the potential gradient is steep. This part must have the highest insulation performance. Since nonuniformity of the potential gradient in the resistor requires the high insulation performance and may be sensitively influenced by potential distribution and variation of stray capacitance around the resistor, the nonuniformity of the potential gradient in the resistor negatively influences a noise characteristic.

Then, an object of the present invention is to provide a geometrical shape, a wiring pattern of a resistance wire and a thick film resistor which improve insulation performance, stability, and noise characteristic of a thick film resistor.

According to the present invention, when a resistance wire having constant thickness and uniform resistivity, which is formed on an insulating substrate, is repetitively bent to an alternate side in zigzags connected to a pair of electrode conductors that face each other, a potential gradient on a wiring plane, where the patterned wire is disposed, is constant by properly selecting the line width, the bending angle, and the spacing between bending vertexes of the resistance wire.

When the resistance wire that connects a pair of electrode conductors facing each other, which is formed on an insulating substrate is the thick film resistor having a pattern in which the proper line width, bending angle, spacing between the bending vertexes of the resistance wire, a potential gradient on a plane where the resistance wire is disposed is uniform, whereby a potential between both electrodes is maintained in a uniform potential gradient.

According to the present invention, it is possible to design a wiring pattern having a uniform potential gradient. Therefore, since the thick film resistor has high stability in potential distribution and variation of stray capacitance around the resistor in addition to an insulation performance, it is possible to form a thick film resistor having an excellent noise characteristic.

DETAILED DESCRIPTION OF THE PREFERRED EMBODIMENTS

Hereinafter, embodiments will be described in detail with reference to the accompanying drawings.

<Wiring Pattern>

When the wiring pattern is formed of a wiring material having a constant thickness and uniform resistivity, the wiring forms an angle θ alternately with a direction (a direction of an average potential gradient) by a straight line for connecting both electrode conductors at a shortest distance, a straight line parallel to the straight line having a length of d is disposed in a vertex part of a bend section, a line width is set to t, and parameters thereof satisfy Expression 1, the potential gradient on a plane where a resistance wire is disposed is uniform and a potential between both electrodes is maintained by a constant potential gradient.

$$\frac{t}{d} = (1 - \cos\theta)\sin\theta \qquad \text{[Expression 1]}$$

Figure 3:
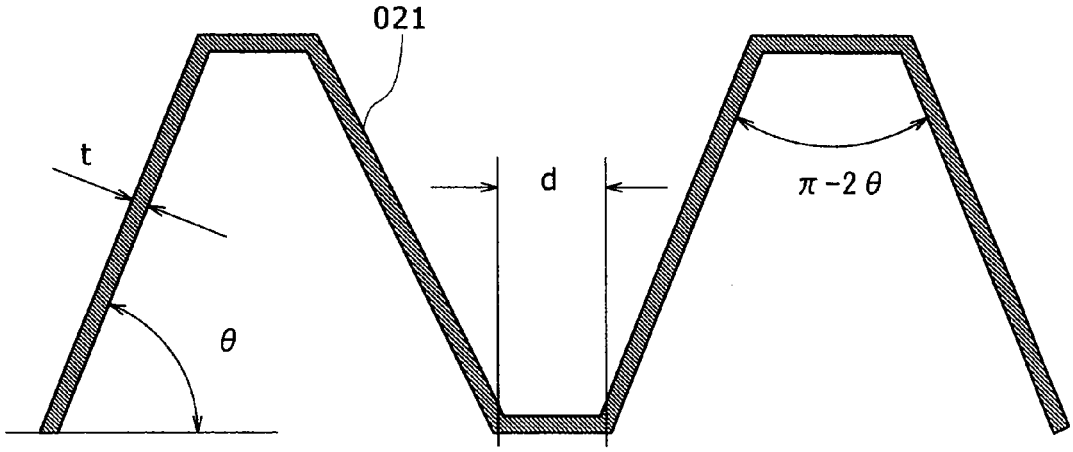
FIG. 3 is an explanatory diagram of a wiring pattern in which a potential gradient is uniform while electric current flows in the wire.

The relationship of the parameters is shown in FIG. 3. Since the relationship shown in Expression 1 is geometrically and uniquely determined on the plane, neither the resistivity nor the thickness of the resistance wire is shown as a parameter. In addition, if the periodicity of the pattern is maintained, the wiring pattern does not depend on whether the period is large or small. Therefore, if the resistance wire has constant thickness and uniform resistivity, any material excluding a superconductor having a resistivity of 0 satisfies Expression 1.

Herein, derivation of Expression 1 will now be described with reference to FIG. 8A.

Figure 8A:
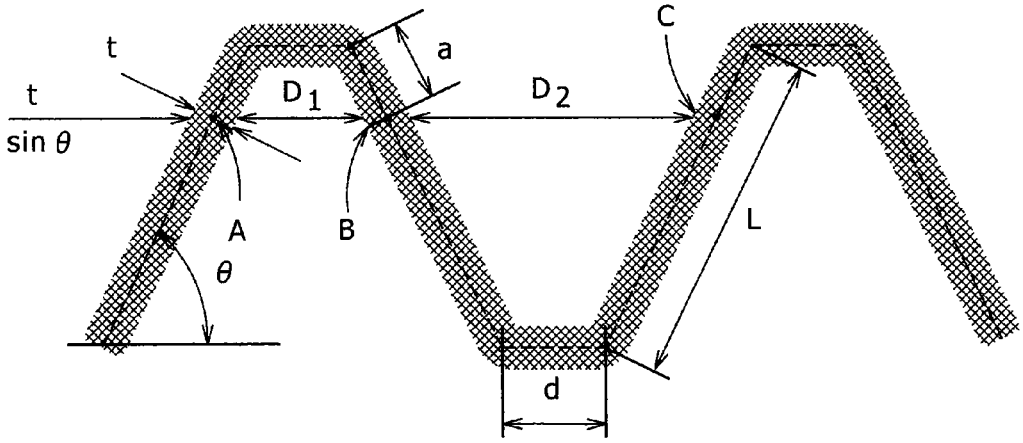
FIG. 8A is an explanatory diagram for deriving the expression of the wiring pattern shown in the first embodiment.

When current flows in a resistance wire pattern shown in FIG. 3 or FIG. 8A, a potential at each point of the resistance wire varies by a voltage drop (the voltage drops in a direction in which the current flows). Therefore, the gradient is generated in a space potential. In a case in which the amount of the flowing current I is constant, the degree of the voltage drop V is proportional to a resistance value R between two points. Since a first relationship shown in Expression 3 is made among a voltage, a resistance R, and a length l of the resistance wire, a spatial potential gradient is determined in a ratio of a length l in accordance with the wiring pattern between two selected points and a spatial distance (direct distance) D between the two points when three points of A, B, and C are determined while being wired as shown in FIG. 8A. That is, the spatial potential gradient becomes uniform when Conditional Expression 2 is satisfied. Reference numeral l represents the length by l of the English small letter.

$$\frac{\ell_{AB}}{D_1} = \frac{\ell_{BC}}{D_2} \qquad \text{[Conditional Expression 2]}$$

$$V = IR = \frac{\rho I}{S}\ell \qquad \text{[Expression 3]}$$

Hereinafter, the length of the resistance wire and the spatial distance are represented by parameters L, a, etc. shown in FIG. 8A are as follows.

$$\left.\begin{aligned} \ell_{AB} &= 2a + d \\ \ell_{BC} &= 2(L - a) + d \end{aligned}\right\} \qquad \text{[Expression 4]}$$

$$\left.\begin{aligned} D_1 &= 2a\cos\theta + d - \frac{t}{\sin\theta} \\ D_2 &= 2(L - a)\cos\theta + d - \frac{t}{\sin\theta} \end{aligned}\right\} \qquad \text{[Expression 5]}$$

When Expressions 4 and 5 are substituted for Conditional Expression 2, Expression 1 can be obtained from Expression 6 described below.

$$\frac{2a + d}{2a\cos\theta + d - \frac{t}{\sin\theta}} = \frac{2(L - a) + d}{2(L - a)\cos\theta + d - \frac{t}{\sin\theta}} \qquad \text{[Expression 6]}$$

Because Expression 1 does not depend on L, only the periodicity is assumed, and further, because Expression 1 does not also depend on a, Express 1 means that the wiring pattern is spatially uniform in all parts (however, on a two-dimensional plane (paper)).

Further, another wiring pattern shown in FIG. 8B will now be described.

Figure 8B:
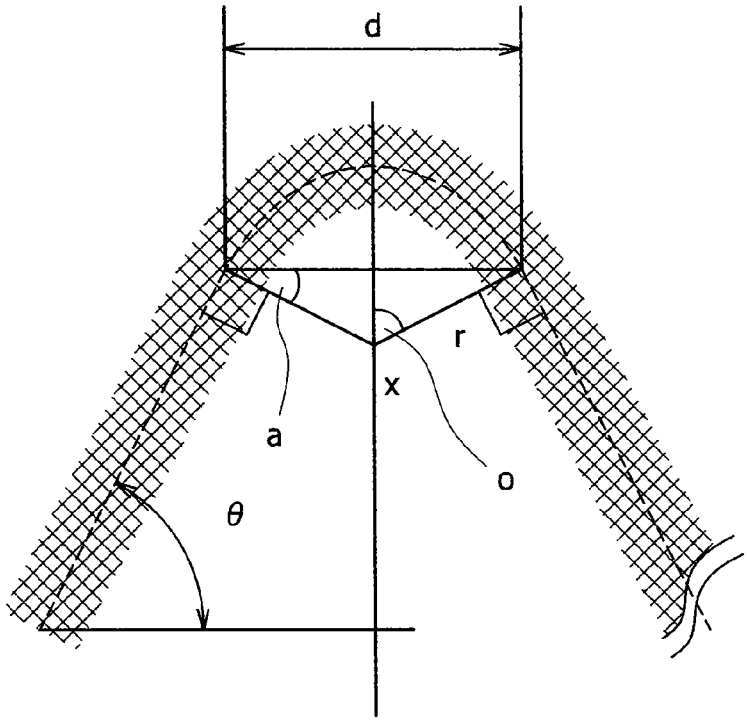
FIG. 8B is an explanatory diagram for deriving the expression of another wiring pattern shown in the first embodiment.

In a case in which the wiring pattern is formed of a wiring material having a constant thickness and uniform resistivity, the wiring forms an angle θ alternately with a direction (a direction of an average potential gradient) by a straight line for connecting both electrode conductors at a shortest distance, a vertex part of a bend section forms a circular arc of a radius r as shown in FIG. 8B, the straight line is connected to the circular arc by a tangent line, a shortest distance between one contact and the other contact of the circular arc is set to d, and a line width is set to t, a potential gradient on a plane where the resistance wire is disposed is uniform and thus a potential between both electrodes is maintained by a constant potential gradient when parameters thereof satisfy Expression 7.

$$\frac{t}{d} = \sin\theta - \theta\cos\theta \quad \text{[Expression 7]}$$

Herein, derivation of Expression 7 will now be described with reference to FIG. 8B.

In Expression 6 described above, when a numerator d is substituted for θ/sin θ·d, Expression 7 is obtained.

First Embodiment of Resistor

Figure 4A:
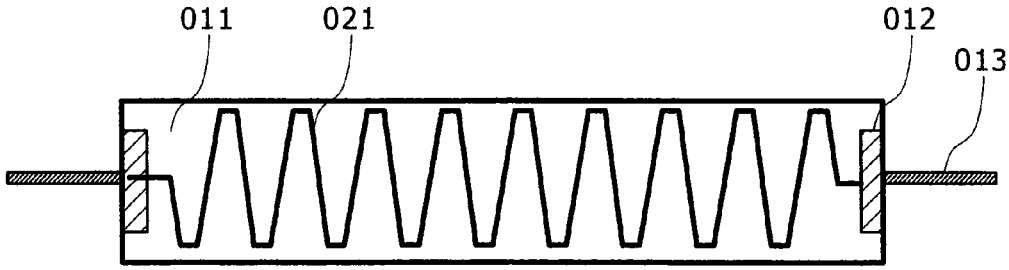
FIG. 4A is a schematic diagram illustrating a first embodiment of the present invention.

FIG. 4A is a schematic diagram of a thick film resistor having a zigzagged wiring pattern according to a first embodiment of the present invention. In the case of a flat plate type thick film resistor, since a wiring pattern of a resistance wire 021 is sintered by screen printing after electrode conductors 012 that face each other are formed on an insulating substrate 011, there is no problem in manufacturing a thick film resistor as shown in FIG. 4A when a mask for the screen printing is designed to satisfy Expression 1.

Figure 1:
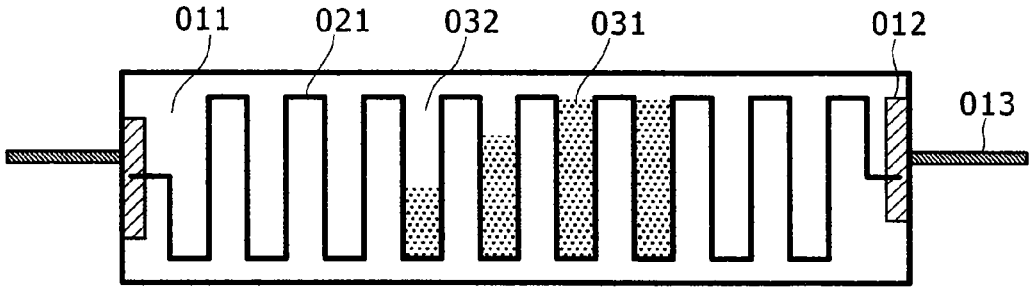
FIG. 1 PRIOR ART
FIG. 1 is a schematic diagram of a flat plate type thick film resistor in the related art.
Figure 2:
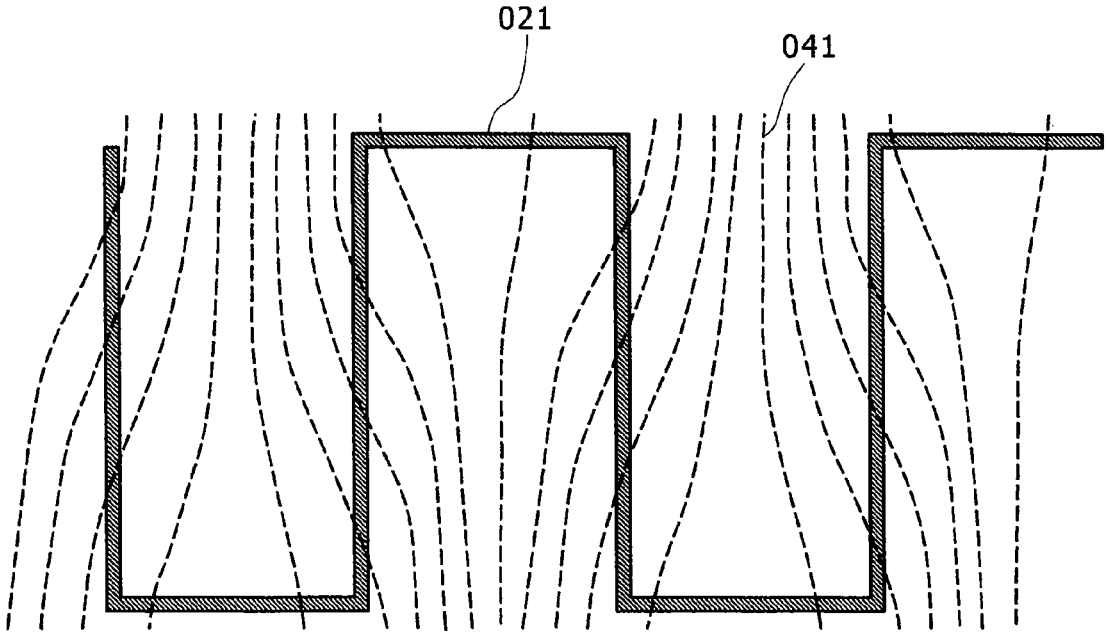
FIG. 2 PRIOR ART
FIG. 2 is a diagram illustrating an electrical field distribution in electric current flowing to a flat plate type thick film resistor in the related art.
Figure 4B:
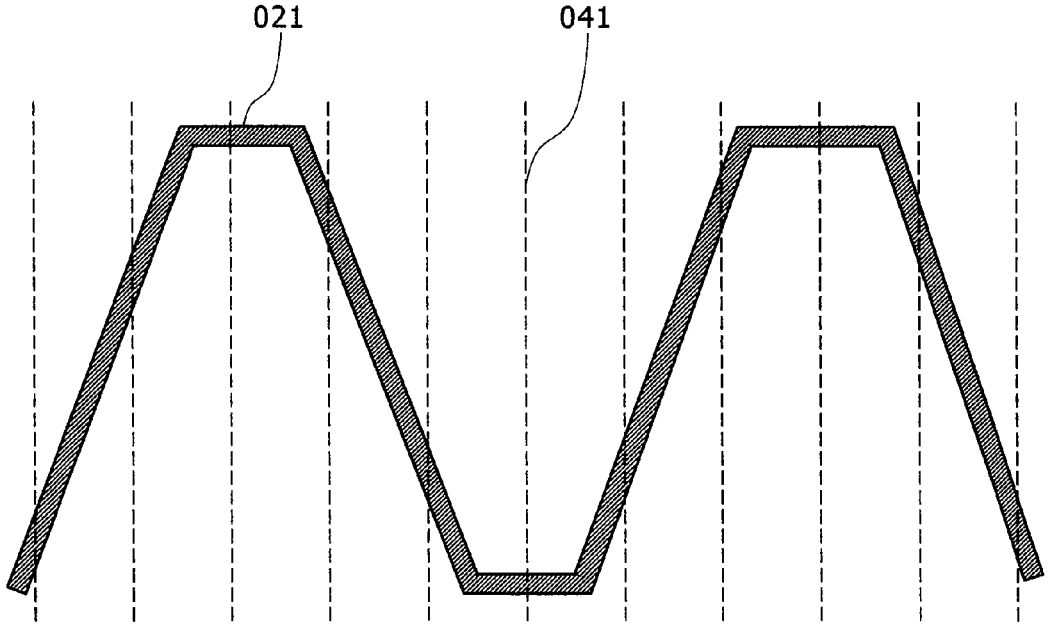
FIG. 4B is a diagram illustrating an electrical field distribution in electric current flowing according to a first embodiment of the present invention.

FIG. 4B illustrates a state of an equipotential line on a plane where a resistance wire is disposed. In FIG. 2, the spacing between the equipotential lines is narrowed outside the bent section of the resistance wire, but in FIG. 4B, the spacing between the equipotential lines is widened outside of the bend section by properly selecting a bending angle and as a result, the equipotential lines 041 become parallel to each other. That is, it can be easily presumed that since the potential gradient on the insulating substrate is uniform, the influence of noise caused due to potential distribution, variation of stray capacitance, etc. around the resistor can be prevented.

Moreover, in the wiring pattern shown in FIG. 2, when the spacing outside the bend section requiring the highest insulation performance can be implemented, the spacing can be narrowed at an angle (π−2θ) toward the inside from the outside of the bend section. At this time, since the resistance wires approach each other from both sides inside of the bend section, it is possible to obtain a long wire by designing the outside of the bend section to be wider beforehand. Since the potential gradient between both electrode conductors that face each other is uniform, a local electric field concentration can be avoided. As a result, since the highest electric field strength between the lines decreases, a voltage resistance performance is improved, such that the thick film resistor can be used as a resistor that is resistant to a sudden high-voltage variation phenomenon (discharge phenomenon), etc.

Second Embodiment of Resistor

The resistivity of the thick film resistor slightly varies depending on the mixing, the sintering temperature, etc. of a paste material used for the resistance wire. Therefore, it is difficult to accurately match a final resistance value with a predetermined value only by designing the geometrical shape of the resistance wire. As a method of adjusting the above, a trimming process to mechanically correct a partial shape of the resistance wire has to be necessarily performed. In general, laser irradiation or sandblasting can be used for the trimming process. However, the laser irradiation and the sandblasting are the same as each other in that parts of all the resistors are cut and removed.

Figure 5:
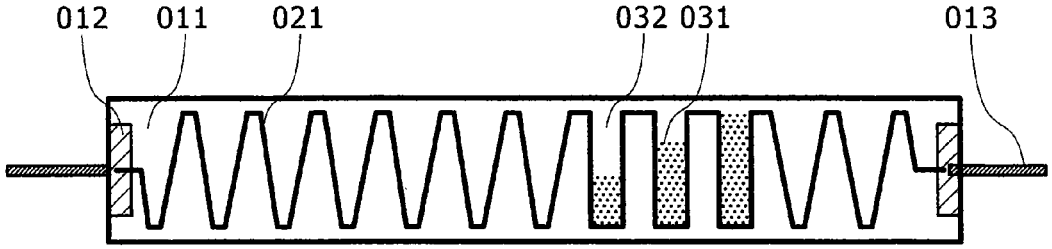
FIG. 5 is a schematic diagram illustrating a second embodiment of the present invention.

Even in the thick film resistor according to the second embodiment of the present invention, the trimming process is considered to be necessarily in practical use performed. It is preferable that the used trimming method maintains the shape that satisfies Expression 1 in order to implement the intended uniformity of the potential distribution on the plane according to the present invention, but when the resistance value is set to the final resistance value in selecting the resistance paste material, selecting the sintering temperature, and a basic design of the wiring pattern, the trimming process needs only to be adjusted. Therefore, even though a trimming method in the related art is adopted, the trimming process does not influence the insulation performance or the noise characteristic of the entire resistor. FIG. 5 illustrates an example in which the resistance wire pattern according to the second embodiment of the present invention and a trimming area 031 in the related art are connected to each other in series. The trimming method in the related art is not limited to the example. Reference numeral 032 in FIG. 5 represents an area after the trimming process is performed.

Third Embodiment of Resistor

Figure 6:
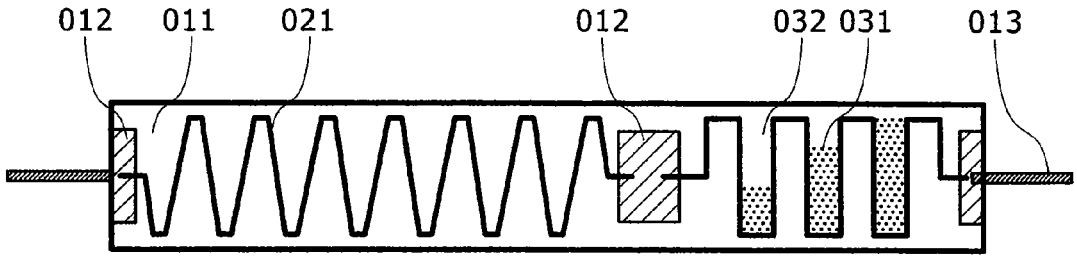
FIG. 6 is a schematic diagram illustrating a third embodiment of the present invention.

FIG. 6 illustrates an example of a case that a resistor according to the present invention and a resistor for adjusting a resistance value by the trimming process are formed on the same insulating substrate. In this example, since the two resistors are connected to each other in series, the two resistors share one electrode. The resistor of the present invention and the resistor for adjusting the resistance value may be separately connected to the electrode and plural resistors may be connected to the electrode so that a combined resistance value becomes a predetermined resistance value after the two resistors are manufactured as completely different components. At this time, the resistor of the present invention takes charge of a main function of the resistance value and the other resistor takes charge of adjusting the final resistance value.

Fourth Embodiment of Resistor

Figure 7A:
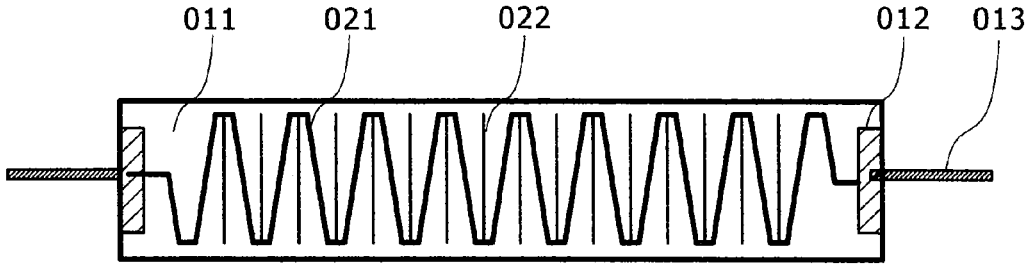
FIG. 7A is a schematic diagram illustrating a fourth embodiment of the present invention.
Figure 7B:
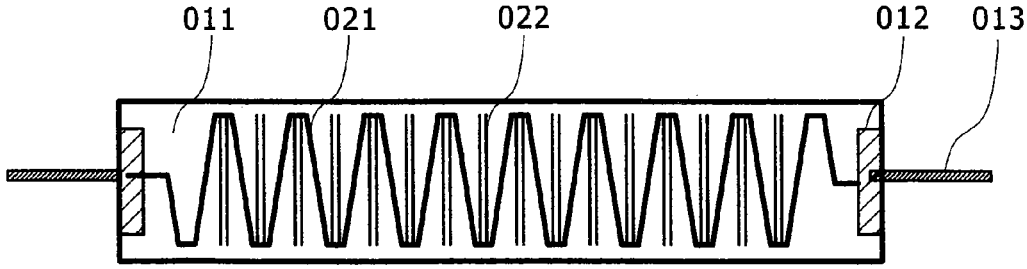
FIG. 7B is another schematic diagram illustrating a fourth embodiment of the present invention.

An embodiment of a thick film resistor in which a measure for noise is performed by adding a capacitance element to a resistance wire while maintaining a wiring pattern in which a potential gradient is uniform on an insulating substrate is shown in FIGS. 7A and 7B. At this time, an added wiring 022 is designed in a straight line shape along an equipotential line so as not to affect the uniformity of the potential gradient. Therefore, the effect of controlling the fluctuation or the wraparound of the equipotential line is expected and when stability or the noise performance is improved from these points, the existence of the straight line pattern is presumed to be effective. FIG. 7B illustrates an example when the added wiring is formed of two wires parallel to each other and clearly illustrates that the added wiring has the capacitance element. In FIGS. 7A and 7B, the simplest straight line is exemplified as the added wiring, but the added wiring may have another shape.

In FIG. 7A, since the added wiring 022 does not directly contribute to the electric conduction, the added wire may be formed of the same resistor material as the resistor or a conductor. Moreover, the line width of the added straight line wiring influences the potential distribution, but there is no big influence on the potential gradient if the line width of the added straight line wiring is substantially equal to the width of the wiring pattern. Therefore, even when a conditional expression is changed, the conditional expression is changed to Expression 8 obtained by changing a parameter d that gives the line width of Expression 1 to d+t.

$$\frac{t}{d+t} = (1-\cos\theta)\sin\theta \quad \text{[Expression 8]}$$

Figure 7C:
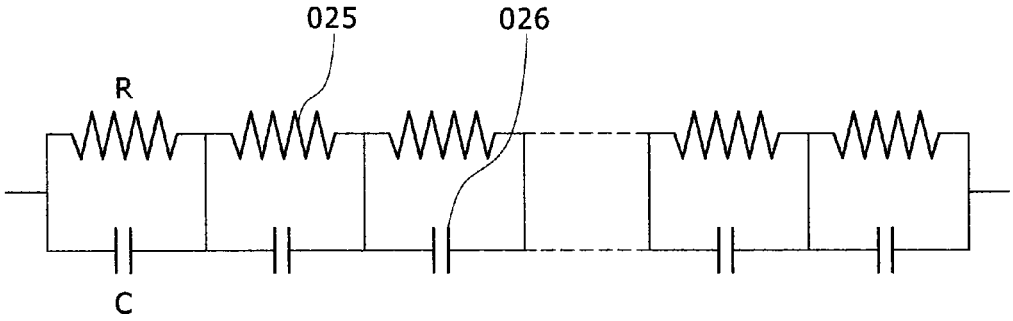
FIG. 7C is an equivalent circuit diagram of a wiring pattern according to a fourth embodiment or a fifth embodiment of the present invention.

FIG. 7C is a schematic diagram of an equivalent circuit of the resistor wiring pattern of FIG. 7A. A resistor 025 corresponding to a resistor of each zigzagged straight line is parallel to a condenser 026. The capacity of the condenser is presumed to have a considerably small value in the embodiment of FIG. 7A, but if the condenser has a shape that does not contradict the uniformity of the potential gradient, a separate design including the capacity in addition to FIG. 7A can be discussed. Since each part of the condenser is expected to have a filter effect for the noise, the effect of protecting the resistor is expected in the improvement of the noise performance, a sudden high-voltage variation (discharge phenomenon), etc.

What is claimed is:

1. A thick film resistor, comprising:

an insulating substrate;

a pair of electrode conductors that are disposed on the insulating substrate; and a winding resistor that is disposed on the insulating substrate between the pair of electrode conductors, wherein the winding resistor is formed by periodically repeating a predetermined pattern having a predetermined film thickness and a line width, and has a shape to satisfy the relationship of the following Expression 1 when one point on a central line of the resistor is represented by $X_A$, an intersection point where a straight line virtually drawn from the point $X_A$ in a direction parallel to a straight line that connects the pair of electrode conductors to each other by the shortest distance intersects the central line of the resistor after the point $X_A$ is represented by $X_B$, and the next intersection point where the straight line intersects the central line of the resistor after the intersection point $X_B$ is represented by $X_C$, a length of a path on the central line of the resistor from the point $X_A$ to the point $X_B$ is represented by $l_{AB}$, a length of a path on the central line of the resistor from the point $X_B$ to the point $X_C$ is represented by $l_{BC}$, a shortest distance from the point $X_A$ to the point $X_B$ is represented by $D_1$, and a shortest distance from the point $X_B$ to the point $X_C$ is represented by $D_2$, $$l_{AB}/D_1 = l_{BC}/D_2. \quad \text{Expression 1}$$

2. A thick film resistor, comprising:

an insulating substrate;

a pair of electrode conductors that are disposed on the insulating substrate; and a winding resistor is disposed on the insulating substrate between the pair of electrode conductors, wherein the winding resistor is formed by periodically repeating a predetermined pattern having a predetermined film thickness and a line width, and has a shape to satisfy the relationship of the following Expression 2 when the predetermined pattern is composed of a set of patterns in which that a first straight line part, a second straight line part, and a third straight line part are successively connected, the first straight line part forms an angle θ with a first direction to connect the pair of electrode conductors to each other by the shortest distance in an anti-clockwise direction, the second straight line part is connected to one end of the first straight line part to be parallel to the first direction, the third straight line part is connected to the other end of the second straight line part to form an angle π−θ with a first direction in the anti-clockwise direction, the predetermined line width is represented by t, and a length of the second straight line part is represented by d, $$t/d = (1-\cos\theta)\sin\theta. \quad \text{Expression 2}$$

3. A thick film resistor, comprising:

an insulating substrate;

a pair of electrode conductors that are disposed on the insulating substrate; and a winding resistor is disposed on the insulating substrate between the pair of electrode conductors, wherein the winding resistor is formed by periodically repeating a predetermined pattern having a predetermined film thickness and a line width, and has a shape to satisfy the relationship of the following Expression 3 when the predetermined pattern is composed of a set of patterns in which a first straight line part, a circular arc part, and a second straight line part are successively connected, the first straight line part forms an angle θ with a first direction to connect the pair of electrode conductors to each other by the shortest distance, one end of the circular arc part is connected to one end of the first straight line part by a tangent line, the second straight line part is connected to the other end of the circular arc part by a tangent line to form an angle π−θ with the first direction in an anti-clockwise direction, the predetermined line width is represented by t, a radius of the circular arc part is represented by r, and a shortest distance to connect the one end with the other end of the circular arc part is represented by d, $$t/d = \sin\theta - \theta\cos\theta. \quad \text{Expression 3}$$

4. The thick film resistor according to claim 1, wherein a resistor for performing a trimming process for adjusting a resistance value is provided in a part of the winding resistor.

5. The thick film resistor according to claim 1, further comprising:

another electrode conductor that is provided between the pair of electrode conductors, wherein the predetermined pattern to satisfy Expression 1 is disposed between one side of the pair of electrode conductors and one side of the another electrode conductor, and the resistor that performs the trimming process for adjusting the resistance value is provided between the other side of the pair of electrode conductors and the other side of the another electrode conductor.

6. The thick film resistor according to claim 1, wherein a resistor that does not contribute to electrical conduction in the resistor or a conductor that does not contribute to the electrical conduction, of which one end is electrically connected to the resistor and the other end is not connected to the resistor is formed in a part of the predetermined pattern along an equipotential line of a potential gradient generated when current flows on the winding resistor.

7. The thick film resistor according to claim 2, wherein the resistor that performs the trimming process for adjusting the resistance value is provided in a part of the winding resistor.

8. The thick film resistor according to claim 2, further comprising:

another electrode conductor that is provided between the pair of electrode conductors, wherein the predetermined pattern to satisfy Expression 2 is disposed between one side of the pair of electrode conductors and one side of the another electrode conductor, and the resistor that performs the trimming process for adjusting the resistance value is provided between the other side of the pair of electrode conductors and the other side of the another electrode conductor.

9. The thick film resistor according to claim 2, wherein a resistor that does not contribute to electrical conduction in the resistor or a conductor that does not contribute to the electrical conduction, of which one end is electrically connected to the resistor and the other end is not connected to the resistor is formed in a part of the predetermined pattern along an equipotential line of a potential gradient generated when current flows on the winding resistor.

10. The thick film resistor according to claim 3, wherein the resistor that performs the trimming process for adjusting the resistance value is provided in a part of the winding resistor.

11. The thick film resistor according to claim 3, further comprising:

another electrode conductor that is provided between the pair of electrode conductors, wherein the predetermined pattern to satisfy Expression 3 is disposed between one side of the pair of electrode conductors and one side of the another electrode conductor, and the resistor that performs the trimming process for adjusting the resistance value is provided between the other side of the pair of electrode conductors and the other side of the another electrode conductor.

12. The thick film resistor according to claim 3, wherein a resistor that does not contribute to electrical conduction in the resistor or a conductor that does not contribute to the electrical conduction, of which one end is electrically connected to the resistor and the other end is not connected to the resistor is formed in a part of the predetermined pattern along an equipotential line of a potential gradient generated when current flows on the winding resistor.

* * * * *